United States Patent [19]

Makimoto et al.

[11] Patent Number: 4,812,791

[45] Date of Patent: Mar. 14, 1989

[54] DIELECTRIC RESONATOR FOR MICROWAVE BAND

[75] Inventors: Mitsuo Makimoto; Motoi Ohba, both of Yokohama, Japan

[73] Assignee: Matsushita Electric Industrial Co. Ltd., Osaka, Japan

[21] Appl. No.: 16,086

[22] Filed: Feb. 18, 1987

[30] Foreign Application Priority Data

| | | | |
|---|---|---|---|
| Feb. 18, 1986 | [JP] | Japan | 61-34622 |
| Feb. 26, 1986 | [JP] | Japan | 61-41220 |
| Mar. 12, 1986 | [JP] | Japan | 61-54055 |

[51] Int. Cl.[4] ..... H01P 7/08; H01P 7/10; H01P 7/00

[52] U.S. Cl. ..... 333/219; 333/204; 333/222; 333/235

[58] Field of Search ..... 333/202, 204, 205, 206, 333/219, 207, 222–226, 235, 246; 331/96, 101, 117 D

[56] References Cited

U.S. PATENT DOCUMENTS

| | | | |
|---|---|---|---|
| 4,570,137 | 2/1986 | DiSilvestro | 333/219 |
| 4,668,925 | 5/1987 | Towatari et al. | 333/219 |

FOREIGN PATENT DOCUMENTS

| | | | |
|---|---|---|---|
| 3408581 | 9/1985 | Fed. Rep. of Germany | 333/202 |
| 1195404 | 11/1985 | U.S.S.R. | 333/219 |

OTHER PUBLICATIONS

"Uwano–Ceramic–Filled Resonator Cuts Costs of Radio–Telephone Filter", Electronics/Jul. 14, 1983; pp. 129–131.

*Primary Examiner*—Marvin L. Nussbaum
*Attorney, Agent, or Firm*—Wenderoth, Lind & Ponack

[57] ABSTRACT

A resonator for microwave or VHF-UHF bands has a ring dielectric plate, one surface of which is metalized to make a resonant line, and at least one of other surfaces of which is also metalized to make a grounded or earth conductor. The resonator is very small in size and has a large unloaded Q value. Several embodiments are disclosed.

13 Claims, 4 Drawing Sheets

DIELECTRIC RESONATOR FOR MICROWAVE BAND

BACKGROUND OF THE INVENTION

The present invention relates to a dielectric resonator for microwave or VHF-UHF band, applicable especially for a microwave filter or an oscillator.

In the conventional microwave filter or oscillator, resonators of TEM mode are very popular. Such resonators are formed by strip line structures, such as an open ended resonant line 1 having a length equal to a half wave length as shown in FIG. 1A, an open ended U-shaped resonant line 2 having a length equal to a half wave-length as shown in FIG. 1B, a ring resonant line 3 having a length equal to a wave-length as shown in FIG. 1C, and a circular resonant line 4 having a gap 6 in which a capacitor 5 is provided to connect both ends of the resonant line 4 for shortening the length of the resonant line 4 to less than a half wave-length as shown in FIG. 1D. These strip line resonators are manufactured on dielectric plates by printing or photoetching techniques. Therefore, these structures may be suitable for mass-production and excellently exhibit uniform performance or characteristics.

However, it is necessary to make the resonator itself large in size, when a large unloaded Q (quality factor) is desired for reducing loss of the resonator. To make the resonator large in size, a thick dielectric plate must be used. This results large in size and expensive in cost.

SUMMARY OF THE INVENTION

It is therefore an object of the present invention to provide a resonator for microwave region small in size.

It is another object of the present invention to provide a resonator for microwave regions having large unloaded Q.

It is a further object of the present invention to provide a resonator for microwave region capable of being manufactured at a low cost.

According to the present invention, a resonator for microwave or VHF-UHF frequency bands is provided which comprises a closed ring dielectric plate, one surface of which is metalized to make a resonant line, and at least another of the surfaces of which is also metalized to make a grounding or earth conductor. It may be desirable to metalize a surface as a grounding conductor that is opposite to the surface on which the resonant line is formed.

BRIEF DESCRIPTION OF THE DRAWINGS

The present invention will be described in further detail with reference to the accompanying drawings, in which.

The same parts and elements are designated by same reference numerals through the figures.

DETAILED DESCRIPTION OF THE INVENTION

Figure 1A:
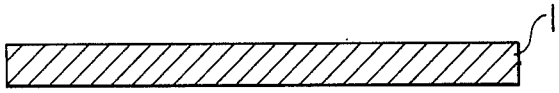
FIGS. 1A through 1D are plan views of several types of microstrip lines of conventional resonators for microwave regions.
Figure 1B:
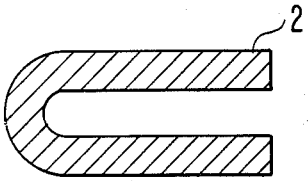
Figure 1C:
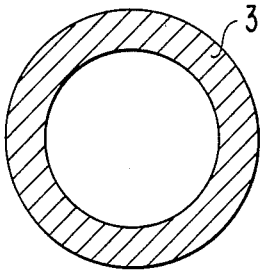
Figure 1D:
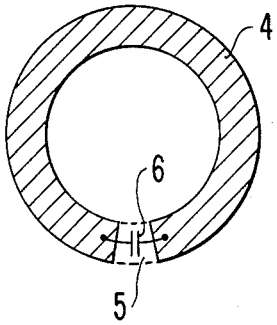
Figure 2A:
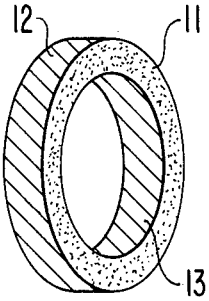
FIGS. 2A through 2C are perspective views of the embodiments of the resonators for microwave regions respectively according to the present invention.

Referring now to FIG. 2A, a dielectric ring 11 is metalized on outer and inner surfaces. The metalized outer surface of the dielectric ring 11 constitutes a grounding or earth electrode 12 and the metalized inner surface of the dielectric ring 11 constitutes a resonant line 13. The resonant line 13 makes a loop which forms a resonator of one wave-length near TEM mode. The resonant frequency and unloaded Q value are adjustable by changing the width or height of the dielectric ring 11.

Figure 2B:
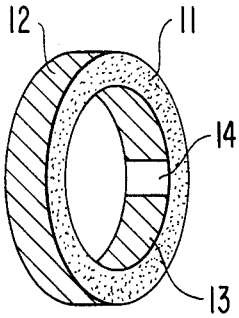

FIG. 2B shows a modified embodiment having a gap 14 on the resonant line 13. The embodiment can realize a resonator of half wave-length, so that the resonator is able to be miniaturized.

Figure 2C:
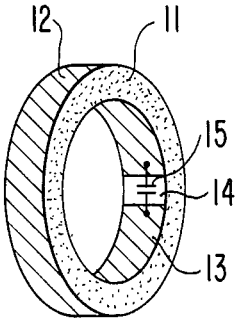

FIG. 2C shows a further modified embodiment having a capacitive element 15 across the gap 14. The embodiment makes it possible to make the length of the resonator line 13 shorter than half wave-length.

Figure 3A:
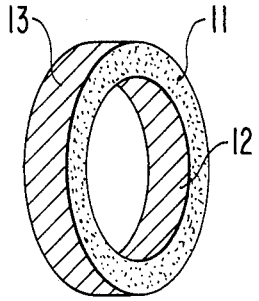
FIGS. 3A through 3C and 4A through 4C are, perspective, views of other embodiments of the resonators for microwave regions, respectively, according to the present invention.
Figure 3B:
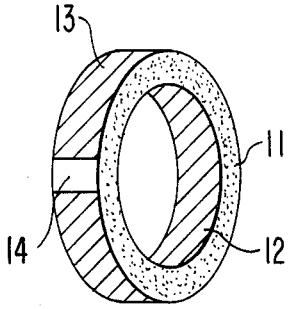
Figure 3C:
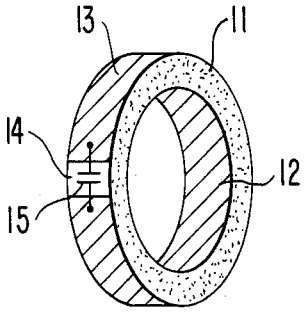

FIGS. 3A through 3C illustrate other embodiments of the resonator of the type wherein the grounding or earth electrode 12 is provided on the inner surface of the dielectric ring 11 and the resonant line 13 is provided on the outer surface of the dielectric ring 11. The gap 14 and the capacitive element 15 are provided on the outer surface side of the dielectric ring 11 as shown in FIGS. 3B and 3C.

Figure 4A:
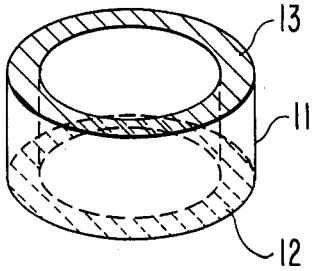
Figure 4B:
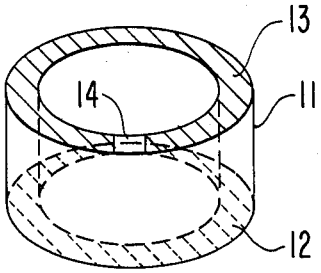
Figure 4C:
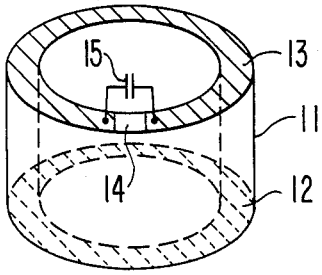

FIGS. 4A through 4C illustrate other embodiments of the resonator of the type wherein the grounding or earth electrode 12 and the resonant line 13 are provided on both flat side surfaces of the dielectric ring 11. The dielectric ring 11 may not only have a circular sleeve shape but may also have a square sleeve shape.

Figure 5A:
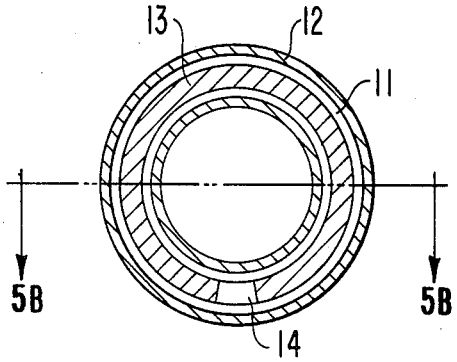
FIG. 5A is a plan view of a resonator for microwave regions of a further embodiment according to the present invention.
Figure 5B:
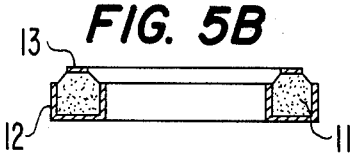
FIG. 5B is a cross-sectional view taken along line 5B—5B in FIG. 5A, FIGS. 5C and 5D are plan views of resonator shown in the resonators of modified embodiments of FIG. 5A.
Figure 5C:
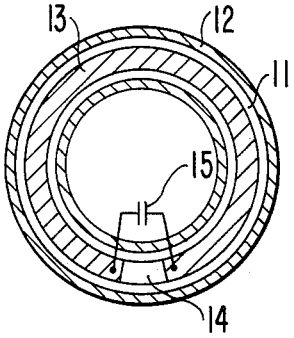
Figure 5D:
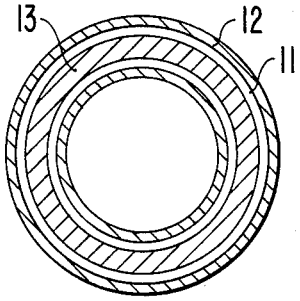
Figure 6A:
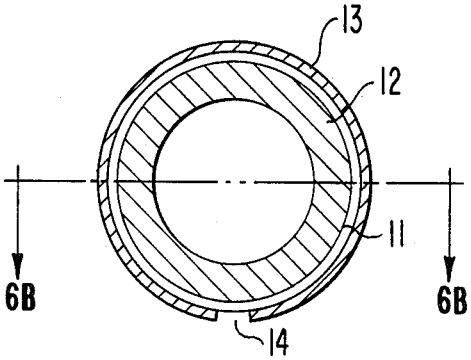
FIG. 6A is a plan view of a resonator for microwave regions of a further embodiment according to the present invention.
Figure 6B:
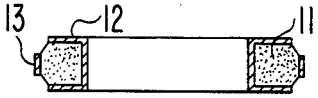
FIG. 6B is a cross-sectional view taken along line 6B—6B in FIG. 6A, FIGS. 6C and 6D are plan views of resonators of modified embodiments of the resonator shown in FIG. 6A, FIG. 7A and 7C through 7D are plan views of a resonator for microwave regions of a further embodiment according to the present invention.
Figure 6C:
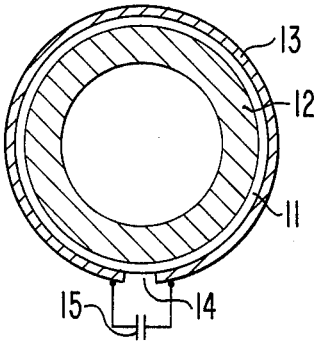
Figure 6D:
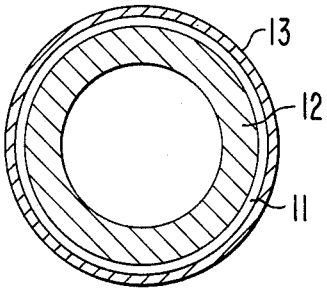
Figure 7A:
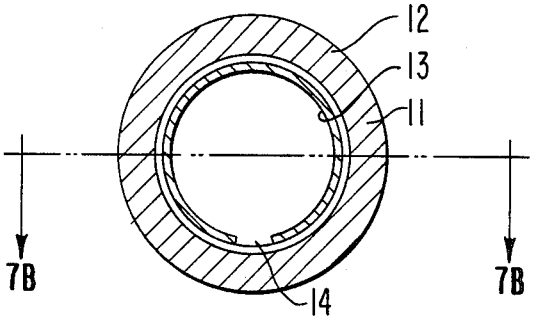
FIG. 7B is a cross-sectional view taken along line 7B—7B in FIG. 7A.
Figure 7B:
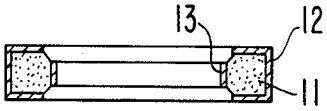
Figure 7C:
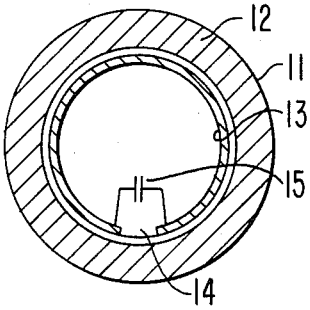
Figure 7D:
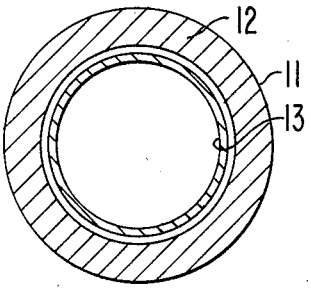

FIGS. 5A and 5B illustrate a further embodiment of the resonator according to the present invention. In this embodiment, a resonant line 13 is provided on one side surface of a dielectric ring 11. The opposite side surface, and inner and outer surfaces of the dielectric ring 11 are connected with each other for forming a grounding or earth electrode 12. Reference numeral 14 designates a gap of the resonant line 13. The resonator of FIGS. 5A and 5B is manufactured by cutting off or removing inner and outer portions of the dielectric ring 12 or the metalized conductor thereon after metalizing all surfaces thereof. Both top end portions of the resonator line 13 may be connected by a capacitive elements 15, as in the embodiments of FIGS. 2C, 3C, and 4C, as shown in FIG. 5C. It is also possible to form the resonator line 13 as a loop, as in the embodiments of FIGS. 2A, 3A, and 4A, as shown in FIG. 5D.

The resonator of FIGS. 5A through 5D are easy to mount on a case or chassis because of the three faces of the grounding or earth electrode 12. Furthermore, the grounding or earth electrode 12 surrounding the three faces of the dielectric ring 11 reduces a leak of electromagnetic field energy from the dielectric ring 11. Additionally, it is possible to remarkably reduce the manufacturing cost of the resonator by simplifying the manufacturing process as described above, that is to say, by separating the resonant line 13 and grounding or earth electrode 12 after metalizing all surfaces of the dielectric ring 11 at inner and outer corner portions thereof.

FIGS. 6A through 6D illustrate modified embodiments of the type wherein the resonant line 13 is provided on a inner surface of the dielectric ring 11.

FIGS. 7A through 7D also illustrate modified embodiments of the type wherein the resonant line 13 is provided on the outer surface of the dielectric ring 11.

These embodiments perform similarly to and have the same properties as the embodiments shown in FIGS. 5A through 5D, respectively.

What is claimed is:

1. A dielectric resonator for the microwave band, said resonator comprising:

a dielectric member having a closed tubular shape comprising inner and outer circumferential surfaces and flat end surfaces;

a resonant line conductor disposed on one of said flat end surfaces of the dielectric member; and a grounding conductor disposed on the other of said flat end surface of the dielectric member.

2. A resonator as claimed in claim 1, wherein said tubular dielectric member is cylindrical.

3. A resonator as claimed in claim 1, wherein said tubular dielectric member is square.

4. A resonator as claimed in claim 1, wherein said first metal layer has respective end portions spaced from each other across a gap extending from said inner circumferential surface to said outer circumferential surface whereby a resonator of a half-wavelength is provided.

5. A resonator as claimed in claim 4, and further comprising a capacitive element extending across said gap and connected between said end portions of the first metal layer.

6. A dielectric resonator for the microwave band, said resonator comprising;

a closed loop-shaped member comprised of a dielectric and having opposite flat end surfaces;

a first conductive member extending over a substantial portion of one of said flat end surfaces, the first conductive member having respective end portions spaced apart from one another across a slit, a second conductive member extending over the other of said flat end surfaces, the second conductive member having a closed-loop shape; and a capacitive element extending across said slit and connected between said end portions of the first conductive member.

7. A dielectric resonator as claimed in claim 6, wherein said closed loop-shaped member has a circular cross-section.

8. A dielectric resonator as claimed in claim 6, wherein said closed loop-shaped member has a square cross-section.

9. A dielectric resonator for the microwave band, said resonator comprising:

a closed ring comprised of a dielectric, said closed ring having an inner circumferential surface, an outer circumferential surface, and respective flat end surfaces each of which extends between said inner and said outer circumferential surfaces;

a first metal layer extending over one of said surfaces, the first metal layer being a resonant line and having respective end portions spaced from each other across a gap whereby a resonator of a half-wavelength is provided;

a second metal layer extending over at least one of the other of said surfaces, said second metal layer being a grounding conductor; and a capacitive element extending across said gap and connected between said end portions.

10. A dielectric resonator for the microwave band, said resonator comprising:

a closed ring comprised of a dielectric, said closed ring having an inner circumferential surface, an outer circumferential surface, and respective flat end surfaces each of which is disposed between said inner and said outer circumferential surfaces;

a first metal layer extending over one of said respective flat end surfaces and having a closed loop shape, the first metal layer being a resonant line; and a second metal layer extending over the other of said flat end surfaces, said second metal layer being a grounding conductor.

11. A dielectric resonator for the microwave band, said resonator comprising:

a closed ring comprised of a dielectric, said closed ring having an inner circumferential surface, and outer circumferential surface, and respective flat end surfaces each of which is disposed between said inner and said outer circumferential surfaces;

a first metal layer extending over one of said respective flat end surfaces and having a closed loop shape, the first metal layer being a resonant line; and a second metal layer extending contiguously over said inner and said outer circumferential surfaces and said other of said respective flat end surfaces, said second metal layer being a grounding conductor.

12. A dielectric resonator for the microwave band, said resonator comprising:

a closed ring comprised of a dielectric, said closed ring having an inner circumferential surface, an outer circumferential surface, and respective flat end surfaces each of which is disposed between said inner and said outer circumferential surfaces;

a first metal layer extending over said outer circumferential surface and having a closed loop shape, the first metal layer being a resonant line; and a second metal layer extending contiguously over said inner circumferential surface and said respective flat end surfaces, said second metal layer being a grounding conductor.

13. A dielectric resonator for the microwave band, said resonator comprising:

a closed ring comprised of a dielectric, said closed ring having an inner circumferential surface, an outer circumferential surface, and respective flat end surfaces each of which is disposed between said inner and said outer circumferential surfaces;

a first metal layer extending over said inner circumferential surface and having a closed loop shape, the first metal layer being a resonant line; and a second metal layer extending contiguously over said outer circumferential surface and said respective flat end surfaces, said second metal layer being a ground conductor.

* * * * *